US010475619B2

(12) United States Patent
Liang et al.

(10) Patent No.: US 10,475,619 B2
(45) Date of Patent: Nov. 12, 2019

(54) MULTILAYER X-RAY SOURCE TARGET

(71) Applicant: General Electric Company, Schenectady, NY (US)

(72) Inventors: Yong Liang, Schenectady, NY (US); Vance Scott Robinson, Schenectady, NY (US); Thomas Robert Raber, Schenectady, NY (US); George Theodore Dalakos, Schenectady, NY (US)

(73) Assignee: GENERAL ELECTRIC COMPANY, Niskayuna, NY (US)

( * ) Notice: Subject to any disclaimer, the term of this patent is extended or adjusted under 35 U.S.C. 154(b) by 282 days.

(21) Appl. No.: 15/199,524

(22) Filed: Jun. 30, 2016

(65) Prior Publication Data

US 2018/0005794 A1 Jan. 4, 2018

(51) Int. Cl.
*H01J 35/12* (2006.01)
*H01J 35/10* (2006.01)

(52) U.S. Cl.
CPC ..... *H01J 35/12* (2013.01); *H01J 35/105* (2013.01); *H01J 2235/084* (2013.01); *H01J 2235/088* (2013.01); *H01J 2235/1291* (2013.01)

(58) Field of Classification Search
CPC ..... H01J 35/105; H01J 35/108; H01J 35/12; H01J 2235/081; H01J 2235/083; H01J 2235/088; H01J 2235/1204; H01J 2235/084; H01J 2235/1291
See application file for complete search history.

(56) References Cited

U.S. PATENT DOCUMENTS 2,087,391 A * 7/1937 Toulmin, Jr. ..... C09C 1/52 116/137 A
4,380,471 A 4/1983 Lee et al.
4,863,798 A * 9/1989 Arenz ..... C04B 30/02 427/248.1
4,998,267 A * 3/1991 Lee ..... G03F 1/22 378/34
5,030,276 A 7/1991 Sung et al.
5,662,720 A 9/1997 O'Tighearnaigh
(Continued)

FOREIGN PATENT DOCUMENTS

DE 2719609 A1 * 11/1978 ..... H01J 35/04
FR 2969178 A1 6/2012
JP 2007-188732 A 7/2007

OTHER PUBLICATIONS

Haghiri-Gosnet, A.M., et al.; "Stresses in Sputtered Tungsten Thin Films"; Applied Surface Science 38; North-Holland, Amsterdam (1989); pp. 295-303.

(Continued)

*Primary Examiner* — Chih-Cheng Kao
(74) *Attorney, Agent, or Firm* — Fletcher Yoder, P.C.

(57) ABSTRACT

The present disclosure relates to the production and use of a multi-layer X-ray source target. In certain implementations, layers of X-ray generating material may be interleaved with thermally conductive layers. To prevent delamination of the layers, various mechanical, chemical, and structural approaches are related, including approaches for reducing the internal stress associated with the deposited layers and for increasing binding strength between layers.

18 Claims, 6 Drawing Sheets

(56) References Cited

U.S. PATENT DOCUMENTS

| | | | | |
|---|---|---|---|---|
| 5,825,848 | A * | 10/1998 | Virshup | H01J 35/108 378/144 |
| 5,952,102 | A | 9/1999 | Cutler | |
| 6,641,861 | B2 | 11/2003 | Saito et al. | |
| 8,752,753 | B2 | 7/2014 | Russell | |
| 2003/0091148 | A1 * | 5/2003 | Bittner | H01J 35/101 378/128 |
| 2005/0074676 | A1 * | 4/2005 | Watanabe | G03F 1/22 430/5 |
| 2008/0019481 | A1 * | 1/2008 | Moy | H01J 35/105 378/119 |
| 2014/0112450 | A1 | 4/2014 | Ogura et al. | |
| 2016/0300686 | A1 * | 10/2016 | Dalakos | H01J 35/12 |

OTHER PUBLICATIONS

Polini, Riccardo; "Chemically Vapour Deposited Diamond Coatings on Cemented Tungsten Carbides: Substrate Pretreatments, Adhesion, and Cutting Performance"; Elsevier—Thin Solid Films; Rome, Italy (2006); pp. 4-13.

Maggs, K. J., et al.; "Adhesion of Diamond Films on Tungsten"; United States Department of the Interior Report of Investigations 9590; Reno Research Center, Reno, Nevada (1995); 15 pages.

Zhu, W., et al.; "Investigation of Adhesion of Diamond Films on Mo, W and Carburized W Substrates"; Elsevier-Diamond and Related Materials; Detroit, Michigan (1995); pp. 220-233.

Shen, Y.G., et al.; "Residual Stress, Microstructure, and Structure of Tungsten Thin Films Depositied by Magnetron Sputtering"; Journal of Applied Physics vol. 87, No. 1 (2000); pp. 177-187.

Dudchik et al., "Multilayer Structures As Targets For Generating Collimated X-Ray Beams," Soviet Technical Physics Letters, American linstitue Of Physics, vol. 16, No. 8, pp. 579-580 (Aug. 1990).

International Search Report and Written Opinion issued in connection with corresponding PCT Application No. PCT/US2017/040167 dated Oct. 20, 2017.

Dalakos et al., Multilayer X-ray source target, GE U.S. Appl. No. 14/982,745, filed Dec. 29, 2015.

* cited by examiner

MULTILAYER X-RAY SOURCE TARGET

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A variety of medical diagnostic, laboratory, security screening, and industrial quality control imaging systems, along with certain other types of systems (e.g., radiation-based treatment systems), utilize X-ray tubes as a source of radiation during operation. Typically, the X-ray tube includes a cathode and an anode. An electron beam emitter within the cathode emits a stream of electrons toward an anode that includes a target that is impacted by the electrons.

A large portion of the energy deposited into the target by the electron beam produces heat within the target, with another portion of the energy resulting in the production of X-ray radiation. Indeed, only about 1% of the energy from the electron beam X-ray target interaction is responsible for X-ray generation, with the remaining 99% resulting in heating of the target. The X-ray flux is, therefore, highly dependent upon the amount of energy that can be deposited into the source target by the electron beam within a given period of time. However, the relatively large amount of heat produced during operation, if not mitigated, can damage the X-ray source (e.g., melt the target). Accordingly, conventional X-ray sources are typically cooled by either rotating or actively cooling the target. However, when rotation is the means of avoiding overheating, the amount of deposited heat along with the associated X-ray flux is limited by the rotation speed (RPM), target heat storage capacity, radiation and conduction cooling capability, and the thermal limit of the supporting bearings. Tubes with rotating targets also tend to be larger and heavier than stationary target tubes. When the target is actively cooled, such cooling generally occurs relatively far from the electron beam impact area, which in turn significantly limits the electron beam power that can be applied to the target. In both situations, the restricted heat removal ability of the cooling methods markedly lowers the overall flux of X-rays that are generated by the X-ray tube.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible embodiments. Indeed, the invention may encompass a variety of forms that may be similar to or different from the embodiments set forth below.

In one implementation, an X-ray source is provided. In such an implementation, the X-ray source includes: an emitter configured to emit an electron beam and a target configured to generate X-rays when impacted by the electron beam. The target includes: at least one X-ray generating layer comprising X-ray generating material, wherein the X-ray generating material within each X-ray generating layer varies in density within the respective X-ray generating layer; and at least one thermally-conductive layer in thermal communication with each X-ray generating layer.

In a further implementation, an X-ray source is provided. In such an implementation, the X-ray source includes a target configured to generate X-rays when impacted by an electron beam. The target includes: one or more X-ray generating layers comprising X-ray generating material, wherein the X-ray generating material within each X-ray generating layer has a density profile that decreases in at least one direction; and at least one thermally-conductive layer in thermal communication with each X-ray generating layer.

In an additional implementation, a method for fabricating an X-ray source target is provided. In accordance with this method, X-ray generating material is deposited on an underlying surface to form an X-ray generating layer. The X-ray generating material is at one or both of different pressures or temperatures so as to have different densities at different depths within the X-ray generating layer. A thermally conductive layer is deposited on the X-ray generating layer surface to form a thermally conductive layer.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
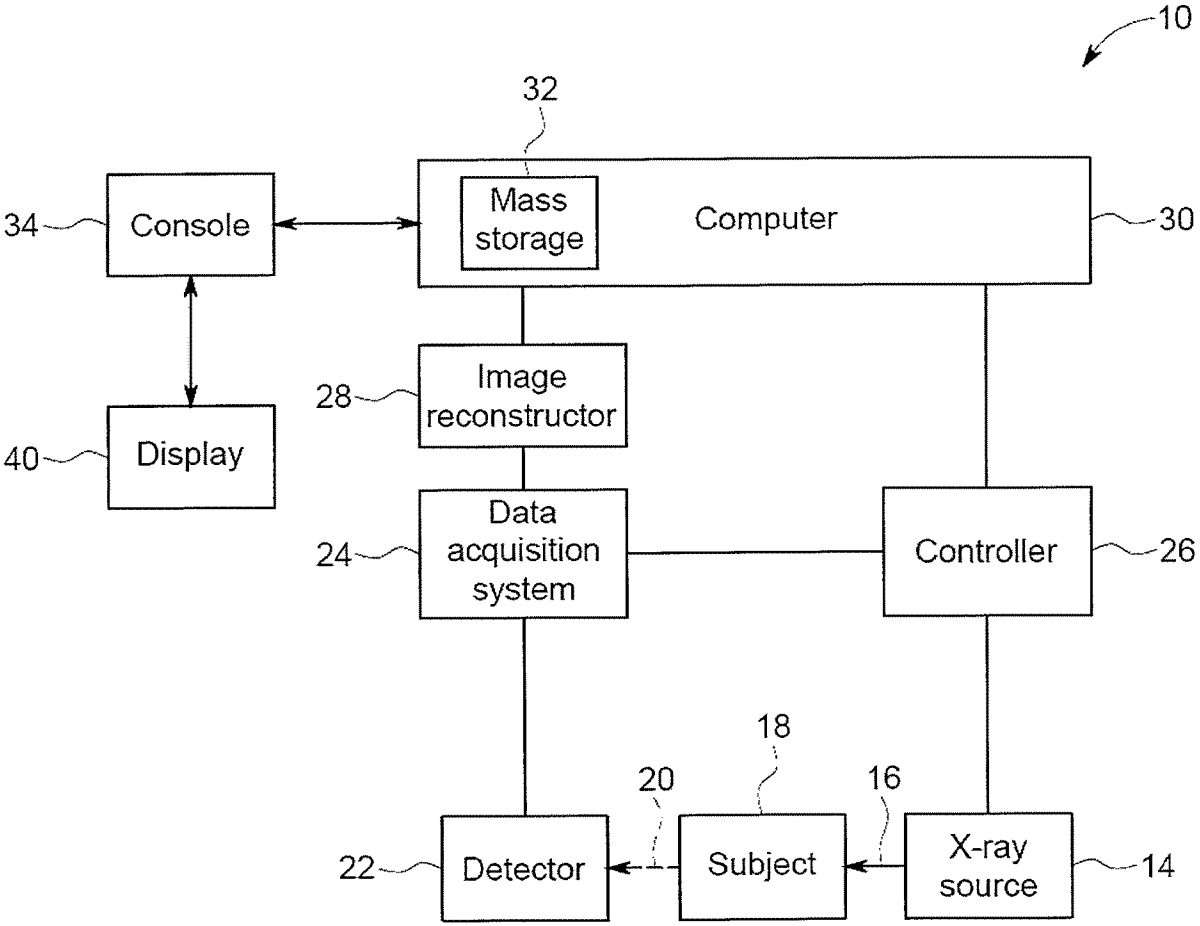
FIG. 1 is a block diagram of an X-ray imaging system, in accordance with aspects of the present disclosure.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

As noted above, the X-ray flux produced by an X-ray source may depend on the energy and intensity of an electron beam incident on the source's target region. The energy deposited into the target produces, in addition to the X-ray flux, a large amount of heat. Accordingly, during the normal course of operation, a source target is capable of reaching temperatures that, if not tempered, can damage the target. The temperature rise, to some extent, can be managed by convectively cooling, also referred to as "direct cooling", the target. However, such cooling is macroscopic and does not occur immediately adjacent to the electron beam impact area where damage i.e. melting, can occur. Without microscopic localized cooling, the overall flux of X-rays produced by the source is limited, potentially making the source unsuitable for certain applications, such as those requiring high X-ray flux densities. Rotating the target such that the electron beam distributes the energy over a larger area can reduce the target temperature locally but it typically requires larger evacuated volumes and the additional complexity of rotating components such as bearings. Further, vibrations associated with rotating targets become prohibitive for high resolution applications where the required spot size is on the order of the amplitude of the vibration. Accordingly, it would be desirable if the source could be operated in a substantially continuous basis in a manner that enables the output of high X-ray flux.

One approach for addressing thermal build-up is to use a layered X-ray source having one or more layers of thermal-conduction material (e.g., diamond) disposed in thermal communication with one or more layers of an X-ray generating material (e.g., tungsten). The thermal-conduction materials that are in thermal communication with the X-ray generating materials generally have a higher overall thermal conductivity than the X-ray generating material. The one or more thermal-conduction layers may generally be referred to as "heat-dissipating" or "heat-spreading" layers, as they are generally configured to dissipate or spread heat away from the X-ray generating materials impinged on by the electron beam to enable enhanced cooling efficiency. The interfaces between X-ray generating and thermal-conduction layers are roughened to improve adhesion between the adjacent layers. Having better thermal conduction within the source target (i.e., anode) allows the end user to operate the source target at higher powers or smaller spot sizes (i.e., higher power densities) while maintaining the source target at the same target operational temperatures. Alternatively, the source target can be maintained at lower temperatures at the same X-ray source power levels, thus increasing the operational lifetime of the source target. The former option translates into higher throughput as higher X-ray source power results in quicker measurement exposure times or improved feature detectability as smaller spot sizes results in smaller features being distinguishable. The latter option results in lower operational (variable) expenses for the end user as targets or tubes (in the case where the target is an integral part of the tube) will be replaced at a lower frequency.

One challenge for implementing such a multi-layered target is delamination of the layers, such as at the tungsten/diamond interface, due to weak adhesion and high stress levels within the layers. As discussed herein, various approaches for improving adhesion between layers and/or reducing internal stress levels in a multi-layer X-ray target are provided. In accordance with certain aspects of these approaches, material density within one or more of the layers may be graded (e.g., have a gradient stress or density profile) or otherwise varied, such as via varying deposition conditions to reduce internal stress within the layer. These effects may vary based on the deposition technique employed and the parameters, either constant or varied, during the deposition. For example, varying deposition parameters in chemical vapor deposition (CVD) and sputtering have varying degrees of influence on the stress and density of the deposited material. Thus, deposition technique and corresponding parameters may be selected so as to obtain the desired internal stress and/or density profile. For example, more energetic processes, such as sputtering or some forms of plasma CVD, can have a large effect on stress within the deposited material.

In addition, in some instances a layer or surface may be etched or otherwise roughened prior to deposition of a subsequent layer in order to improve adhesion between the layers. In addition, in certain implementations one or more interlayers (such as a carbide interlayer) may be deposited between X-ray generating and thermal-conduction layers to improve adhesion, such as to facilitate or provide chemical bonding. With respect to the various deposition steps discussed herein, any suitable deposition technique for a given layer and/or material (e.g., ion-assisted sputtering deposition, chemical vapor deposition, plasma vapor deposition, electro-chemical deposition, and so forth) may be employed.

Multi-layer x-ray sources as discussed herein may be based on a stationary (i.e., non-rotating) anode structure or a rotating anode structure and may be configured for either reflection or transmission X-ray generation. As used herein, a transmission-type arrangement is one in which the X-ray beam is emitted from a surface of the source target opposite the surface that is subjected to the electron beam. Conversely, in a reflection arrangement, the angle at which X-rays leave the source target is typically acutely angled relative to the perpendicular to the source target. This effectively increases the X-ray density in the output beam, while allowing a much larger thermal spot on the source target, thereby decreasing the thermal loading of the target.

By way of an initial example, in one implementation an electron beam passes through a thermally conductive layer (e.g., a diamond layer) and is preferentially absorbed by an underlying X-ray generating (e.g., tungsten) layer. Alternatively, in other implementations an X-ray generating layer may be the first (i.e., top) layer, with a thermally-conductive layer underneath. In both instances, additional alternating layers of X-ray generating and thermally-conductive material may be provided as a stack within the X-ray source target (with either the X-ray generating or thermally-conductive layer on top), with successive alternating layers adding X-ray generation and thermal conduction capacity. As will be appreciated, the thermally conductive and X-ray generating layers do not need to be the same thickness (i.e., height) with respect to the other type of layer or with respect to other layers of the same type. That is, layers of the same type or of different types may differ in thickness from one another. The final layer on the target can be either the X-ray generating layer or the thermally-conductive layer.

With the preceding in mind, and referring to FIG. 1, components of an X-ray imaging system 10 are shown as including an X-ray source 14 that projects a beam of X-rays 16 through a subject 18 (e.g., a patient or an item undergoing security, industrial inspection, or quality control inspection).

A beam-shaping component or collimator may also be provided in the system 10 to shape or limit the X-ray beam 16 so as to be suitable for the use of the system 10. It should be noted that the X-ray sources 14 disclosed herein may be used in any suitable imaging context or any other X-ray implementation. By way of example, the system 10 may be, or be part of, a fluoroscopy system, a mammography system, an angiography system, a standard radiographic imaging system, a tomosynthesis or C-arm system, a computed tomography system, and/or a radiation therapy treatment system. Further, the system 10 may not only be applicable to medical imaging contexts, but also to various inspection systems for material characterization, industrial or manufacturing quality control, luggage and/or package inspection, and so on. Accordingly, the subject 18 may be a laboratory sample, (e.g., tissue from a biopsy), a patient, luggage, cargo, manufactured parts, nuclear fuel, or other material of interest.

The subject may, for example, attenuate or refract the incident X rays 16 and produce the projected X-ray radiation 20 that impacts a detector 22, which is coupled to a data acquisition system 24. It should be noted that the detector 22, while depicted as a single unit, may include one or more detecting units operating independently or in conjunction with one another. The detector 22 senses the projected X-rays 20 that pass through or off of the subject 18, and generates data representative of the radiation 20. The data acquisition system 24, depending on the nature of the data generated at the detector 22, converts the data to digital signals for subsequent processing. Depending on the application, each detector 22 produces an electrical signal that may represent the intensity and/or phase of each projected X-ray beam 20. While the depicted system 10 depicts the use of a detector 22, in certain implementations the produced X-rays 16 may not be used for imaging or other visualization purposes and may instead be used for other purposes, such as radiation treatment of therapy. Thus, in such contexts, no detector 22 or data acquisition subsystems may be provided.

An X-ray controller 26 may govern the operation of the X-ray source 14 and/or the data acquisition system 24. The controller 26 may provide power and timing signals to the X-ray source 14 to control the flux of the X-ray radiation 16, and to control or coordinate with the operation of other system features, such as cooling systems for the X-ray source, image analysis hardware, and so on. In embodiments where the system 10 is an imaging system, an image reconstructor 28 (e.g., hardware configured for reconstruction) may receive sampled and digitized X-ray data from the data acquisition system 24 and perform high-speed reconstruction to generate one or more images representative of different attenuation, differential refraction, or a combination thereof, of the subject 18. The images are applied as an input to a processor-based computer 30 that stores the image in a mass storage device 32.

The computer 30 also receives commands and/or scanning parameters from an operator via a console 34 that has some form of operator interface, such as a keyboard, mouse, voice activated controller, or any other suitable input apparatus. An associated display 40 allows the operator to observe images and other data from the computer 30. The computer 30 uses the operator-supplied commands and parameters to provide control signals and information to the data acquisition system 24 and the X-ray controller 26.

Figure 2:
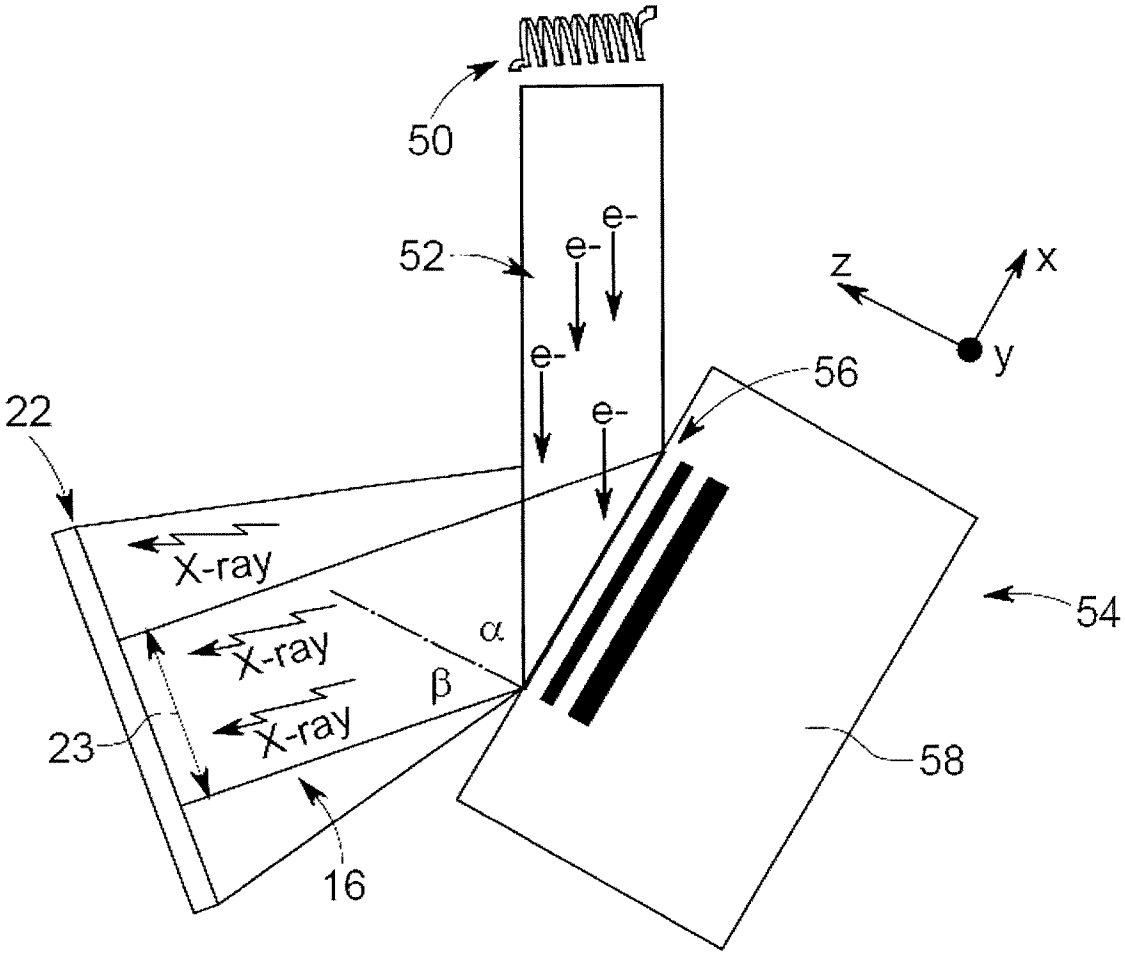
FIG. 2 depicts a generalized view of a multi-layer X-ray source and detector arrangement, in accordance with aspects of the present disclosure.

Referring now to FIG. 2, a high level view of components of an X-ray source 14, along with detector 22, are depicted. The aspects of X-ray generation shown are consistent with a reflective X-ray generation arrangement that may be consistent with either a rotating or stationary anode. In the depicted implementation, an X-ray source includes an electron beam emitter (here depicted as an emitter coil 50) that emits an electron beam 52 toward a target region of X-ray generating material 56. The X-ray generating material may be a high-Z material, such as tungsten, molybdenum, titanium-zirconium-molybdenum alloy (TZM), tungsten-rhenium alloy, copper-tungsten alloy, chromium, iron, cobalt, copper, silver, or any other material or combinations of materials capable of emitting X-rays when bombarded with electrons). The source target may also include one or more thermally-conductive materials, such as substrate 58, or thermally conductive layers or other regions surrounding and/or separating layers of the X-ray generating material 56. As used herein, a region of X-ray generating material 56 is generally described as being an X-ray generating layer of the source target, where the X-ray generating layer has some corresponding thickness, which may vary between different X-ray generating layers within a given source target.

The electron beam 52 incident on the X-ray generating material 56 generates X-rays 16 that are directed toward the detector 22 and which are incident on the detector 22, the optical spot 23 being the area of the focal spot projected onto the detector plane. The electron impact area on the X-ray generating material 56 may define a particular shape, thickness, or aspect ratio on the source target (i.e., anode 54) to achieve particular characteristics of the emitted X-rays 16. For example, the emitted X-ray beam 16 may have a particular size and shape that is related to the size and shape of the electron beam 52 when incident on the X-ray generating material 56. Accordingly, the X-ray beam 16 exits the source target 54 from an X-ray emission area that may be predicted based on the size and shape of the impact area. In the depicted example the angle between the electron beam 52 and the normal to the target is defined as a. The angle $\beta$ is the angle between the normal of the detector and the normal to the target. Where b is the thermal focal spot size at the target region 56 and c is optical focal spot size, $b=c/\cos\beta$. Further, in this arrangement, the equivalent target angle is $90-\beta$.

As discussed herein, certain implementations employ a multi-layer source target 54 having two or more X-ray generating layers in the depth or z-dimension (i.e., two or more layers incorporating the X-ray generating material) separated by respective thermally conductive layers (including top layers and/or substrates 58). Such a multi-layer source target 54 (including the respective layers and/or intra-layer structures and features discussed herein) may be fabricated using any suitable technique, such as suitable semiconductor manufacturing techniques including vapor deposition (such as chemical vapor deposition (CVD), sputtering, atomic layer deposition), chemical plating, ion implantation, or additive or reductive manufacturing, and so on. In particular, certain fabrication approaches discussed herein may be utilized to make a multi-layer source target 54.

Referring again to FIG. 2, generally the thermally conductive layers (generally defined in the x,y plane and having depth or elevation in the z-dimension shown) are configured to conduct heat away from the X-ray generating volume during operation. That is, the thermal materials discussed herein have thermal conductivities that are higher than those exhibited by the X-ray generating material. By way of non-limiting example, a thermal-conducting layer may include carbon-based materials including but not limited to highly ordered pyrolytic graphite (HOPG), diamond, and/or metal-based materials such as beryllium oxide, silicon carbide, copper-molybdenum, copper, tungsten-copper alloy, or any combination thereof. Alloyed materials such as silver-diamond may also be used. Table 1 below provides the composition, thermal conductivity, coefficient of thermal expansion (CTE), density, and melting point of several such materials.

TABLE 1

| Material | Composition | Thermal Conductivity W/m-K | CTE ppm/K | Density g/cm$^3$ | Melting point ° C. |
|---|---|---|---|---|---|
| Diamond | Poly-crystalline diamond | ≥1800 | 1.5 | 3.5 | NA* |
| Beryllium oxide | BeO | 250 | 7.5 | 2.9 | 2578 |
| CVD SiC | SiC | 250 | 2.4 | 3.2 | 2830 |
| Highly oriented pyrolytic graphite | C | 1700 | 0.5 | 2.25 | NA* |
| Cu—Mo | Cu—Mo | 400 | 7 | 9-10 | 1100 |
| Ag-Diamond | Ag-Diamond | 650 | <6 | 6-6.2 | NA* |
| OFHC | Cu | 390 | 17 | 8.9 | 1350 |

*Diamond or HOPG graphitizes at ~1,500° C., before melting, thus losing the thermal conductivity benefit. In practice, this may be the limiting factor for any atomically ordered carbon material instead of melting.

It should be noted that the different thermally-conductive layers, structures, or regions within a source target 54 may have correspondingly different thermally-conductive compositions, different thicknesses, and/or may be fabricated differently from one another, depending on the respective thermal conduction needs at a given region within the source target 54. However, even when differently composed, such regions, if formed so as to conduct heat from the X-ray generating materials, still constitute thermally-conductive layers (or regions) as used herein. For the purpose of the examples discussed herein, diamond is typically referenced as the thermally-conductive material. It should be appreciated however that such reference is merely employed by way of example and to simplify explanation, and that other suitable thermally-conductive materials, including but not limited to those listed above, may instead be used as a suitable thermally-conductive material.

As discussed herein, in various implementations respective depth (in the z-dimension) within the source target 54 may determine the thickness of an X-ray generating layer found at that depth, such as to accommodate the electron beam incident energy expected at that depth. That is, X-ray generating layers or regions at different depths within a source target 54 may be formed so as to have different thicknesses. Similarly, depending on heat conduction requirements at a given depth, the differing thermal-conductive layers may also vary in thickness, either based upon their depth in the source target 54 or for other reasons related to optimizing heat flow and conduction.

Figure 3:
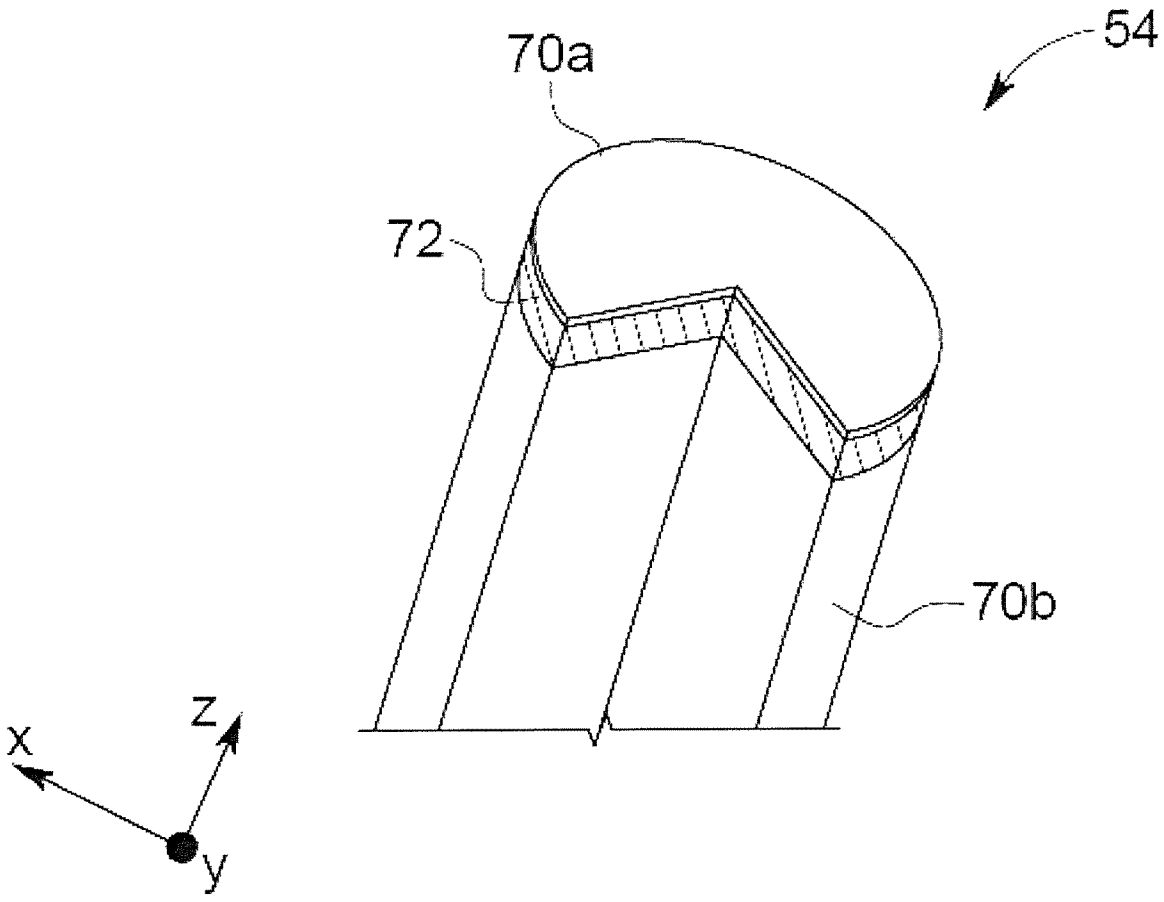
FIG. 3 depicts cut-away perspective view of a layered X-ray source, in accordance with aspects of the present disclosure.

By way of example of these concepts, FIG. 3 depicts a partial-cutaway perspective view of a stationary X-ray source target (i.e., anode) 54 having alternating layers, in the z-dimension, of: (1) a first thermally-conductive layer 70*a* (such as a thin diamond film, approximately 0 to 15 μm in thickness) on face of the source target 54 to be impacted by the electron beam 52; (2) an X-ray generating layer 72 of X-ray generating material 56 (i.e., a high-Z material, such as a tungsten layer approximately 10 to 40 μm in thickness); and (3) a second thermally-conductive layer 70*b* (such as a diamond layer or substrate approximately 1.2 mm in thickness) underlying the X-ray generating layer 72. It should be noted that, in other implementations, layer (1) is optional and may be omitted (i.e., thickness of 0), making the X-ray generating layer 72 the top layer of the source target 54. In the depicted example, which is shown to provide useful context for the examples to follow, the X-ray generating material within the X-ray generating layer 72 is continuous throughout the layer 72. Further, the example of FIG. 3 depicts only a single X-ray generating layer 72, though the single X-ray generating layer is part of a multi-layer source target 54 in that the X-ray generating layer 72 is sandwiched between two thermal-conduction layers 70*a* and 70*b*.

With the preceding in mind, and as noted above, one issue in fabricating and using multi-layer X-ray source targets 54 is the delamination of different layers of the source target 54. To address these delamination issues, and as discussed in greater detail below, adhesion between X-ray generating layers (e.g., tungsten layers) and thermal-conduction layers (e.g., diamond layers) is improved via one or more of mechanical or structural approaches, chemical approaches, and/or use of one or more interface layers. By way of example, mechanical adhesion improvements may include increasing surface area of the X-ray generating layer (e.g., tungsten) for a higher degree of interlocking at the micrometer-level between the X-ray generating and thermal conduction layers.

In other approaches, an interface layer may be optionally provided between X-ray generating and thermally-conductive layers to promote bonding between the layers. For example, improved bonding between diamond and tungsten layers may be accomplished by depositing a thin carbide layer, such as tungsten carbide, between tungsten and diamond layers. In such an approach, the carbide interlayer provides a chemical bonding of the diamond and tungsten layers and serves as a barrier layer that limits the interdiffusion of tungsten and carbon. The tungsten carbide layer can be formed by treating the tungsten surface in a carbon rich environment at high temperatures, by depositing diamond on a tungsten layer at high temperatures using a CVD method, for example, or by post-deposition annealing. In an example of such an approach, it may be desirable that the tungsten carbide layer has the tungsten carbide stoichiometry with a thickness of approximately 100 nm to minimize local heating. In addition to tungsten carbide, other carbides such as silicon carbide, titanium carbide, tantalum carbide, and so forth can be used to improve adhesion between tungsten and diamond layers.

In addition, in certain implementations a non-carbide interlayer can be deposited or formed on the carbide interlayer to further limit carbide growth at the interface. The attributes of this non-carbide interlayer, when present, are ductile behavior (by itself or alloyed with tungsten) and little or no carbide formation in a carbon rich environment. Examples of materials suitable for forming such a non-carbide interlayer include, but are not limited to: rhenium, platinum, rhodium, iridium, and so forth.

Figure 4:
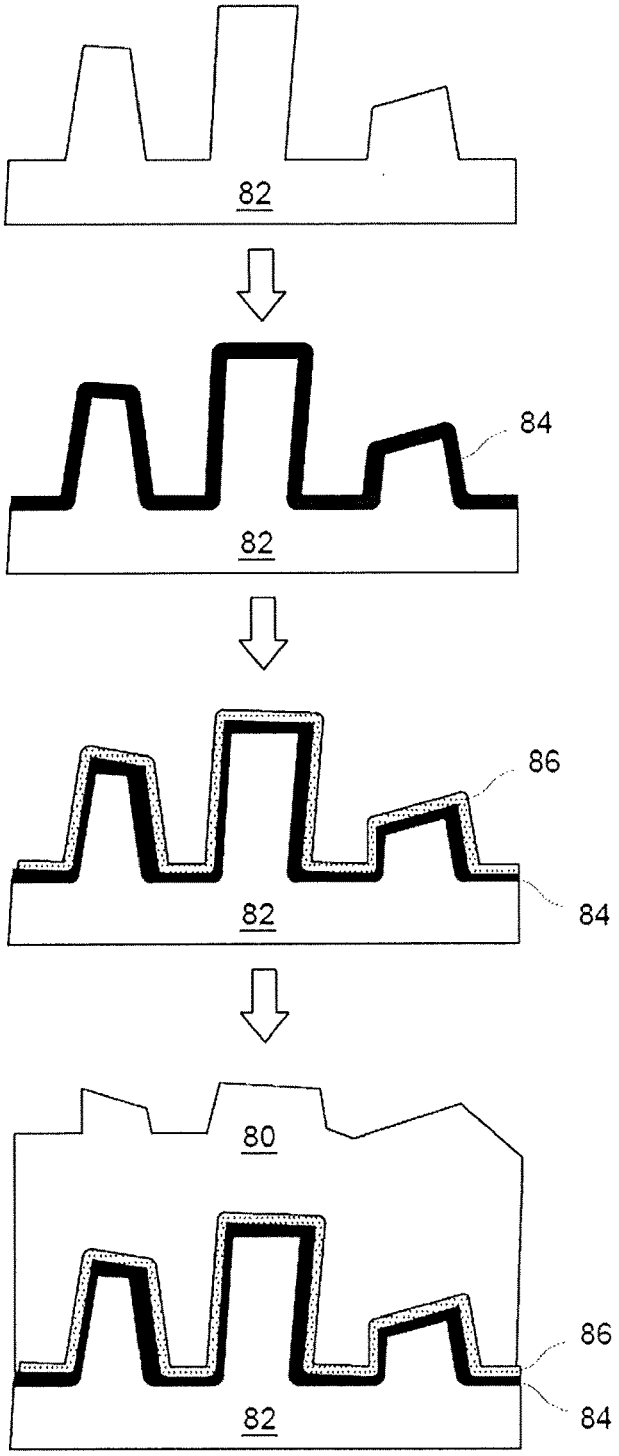
FIG. 4 depicts a generalized process flow of fabrication of a tungsten layer over a roughened diamond layer, in accordance with aspects of the present disclosure.
Figure 5:
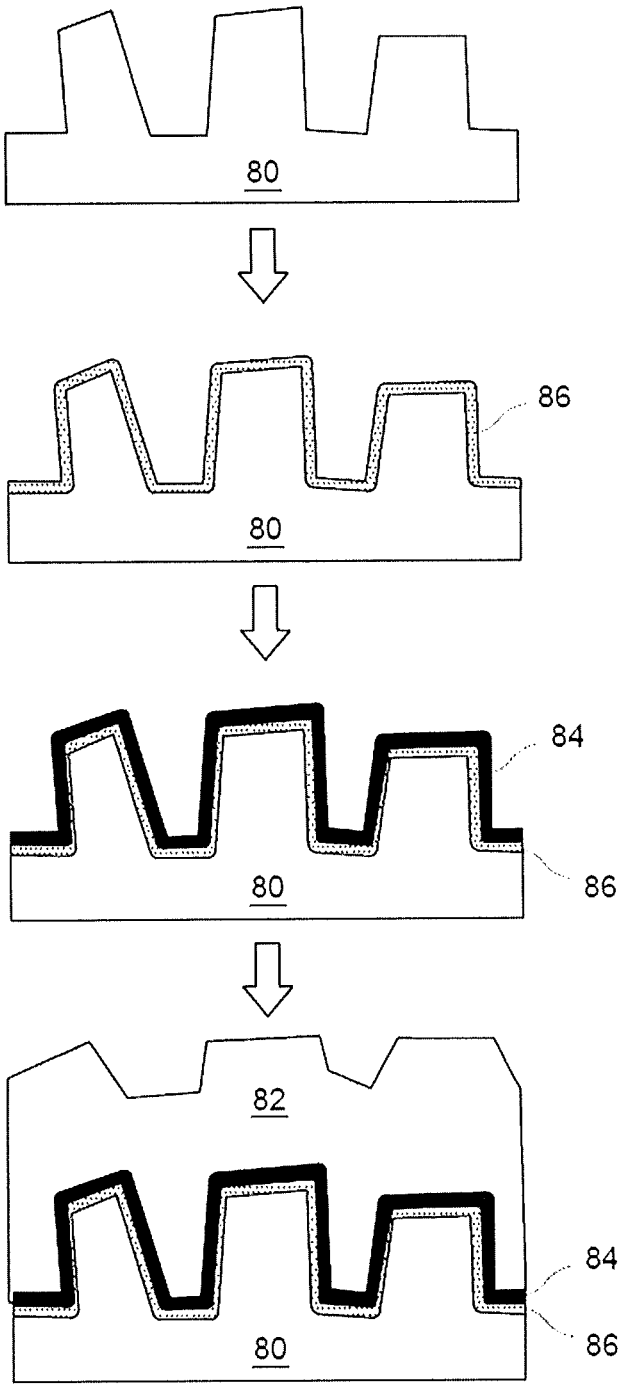
FIG. 5 depicts a generalized process flow of fabrication of a diamond layer over a roughened tungsten layer, in accordance with aspects of the present disclosure.

With these approaches in mind, FIGS. 4 and 5 depict two simplified process type views showing fabrication of two-layers of a multi-layer source target, along with optional interlayers. Certain specific fabrication steps that may be applicable to the generalized discussion of FIGS. 4 and 5 are discussed in greater detail in the context of FIG. 6, which describes a more detailed process flow.

In the present examples, FIG. 4 shows fabrication steps for fabricating an X-ray generating tungsten layer 80 over a thermally conductive diamond layer 82. In this example, at the first step, a roughened diamond surface is initially provided. At a second step, a carbide interlayer 84 is formed over the roughened diamond surface and, in a next step, non-carbide interlayer 86 is formed over the carbide interlayer 84. As noted above, the carbide interlayer 84 and non-carbide interlayer 86 are both optional and one or both may be absent from the multi-layer target structure 54. In the final depicted step, a layer 80 of tungsten (i.e., an X-ray generating material) is deposited over the diamond layer 82 and any interlayers that may be present. In the depicted example, the roughened surface of the diamond layer 82 provides additional mechanical stability to the bond between the diamond layer 82 and tungsten layer 80, helping prevent delamination. In addition, one or both of the interlayers 84, 86 (if present) may provide chemical adhesion or bonding to further stabilize the multi-layer arrangement and prevent delamination.

In FIG. 5, a similar sequence of steps is depicted, but using an X-ray generating tungsten layer 80 as the underlying layer. In this example, at the first step, a roughened tungsten surface is initially provided. At a second step, a non-carbide interlayer 86 is formed over the roughened tungsten surface and, in a next step, carbide interlayer 84 is formed over the non-carbide interlayer 86. As in the preceding example, the carbide interlayer 84 and non-carbide interlayer 86 are both optional and one or both may be absent from the multi-layer target structure 54. In the final depicted step, a layer 82 of diamond (i.e., a thermally-conductive material) is deposited over the tungsten layer 80 and any interlayers that may be present. In the depicted example, the roughened surface of the tungsten layer 80 provides additional mechanical stability to the bond between the diamond layer 82 and tungsten layer 80, helping prevent delamination. In addition, as in the preceding example, one or both of the interlayers 84, 86 (if present) may provide chemical adhesion or bonding to further stabilize the multi-layer arrangement and prevent delamination.

As will be appreciated, the respective examples shown in FIGS. 4 and 5 represent generalized examples of the formation of an X-ray generating and thermally conductive layers for use in a multi-layer source target 54. However, multiple repetitions of these steps may be performed in order to generate a stack of such layers. In addition, the examples of FIGS. 4 and 5 primarily convey the use of one-or more interlayers and the use of roughened surfaces as approaches for addressing delamination of layers of a multi-layer source target.

As discussed herein, other aspects of the fabrication process may also be controlled so as to reduce or eliminate delamination. By way of example, the layer deposition processes may also play a role in addressing delamination. For instance, conventional sputtering or ion-assisted sputtering techniques can be used to deposit a tungsten film with desired stress profiles in the film to reduce internal stress within the layer. In particular, the level of stress can be controlled by deposition pressure and power. To achieve better film conformality and reduce the overall stress in the tungsten film, one may initiate the deposition at a lower pressure, then increase the pressure as the deposition progresses to either partially or completely relieve the internal stress. Alternatively, one may initiate the deposition at a lower pressure, increase the pressure as the deposition progresses to either partially or completely relieve the stress, then increase the pressure near the end of the deposition to further tailor the stress profile so that the stress in the film and tungsten density are high at both interfaces but low in the middle of the film. Similarly, deposition temperature may be adjusted in addition to or instead of pressure to achieve the desired internal stress profile. Such deposition and/or temperature mediated internal stress profiles are also depicted in the context of FIGS. 4 and 5, in which the tungsten layers 80 are depicted as being deposited so as to have a density gradient or profile that decreases as the deposition or fabrication proceeds. That is, the tungsten layer 80 in both examples is depicted as having non-uniform density and a non-uniform internal stress profile.

Additionally, ion assisted sputtering can be used to increase the film density as well as atom intermingling at the interface so as to assure good contact and adhesion between two dissimilar materials at the interface. Furthermore, biasing the substrate during growth independently can increase this intermingling while having deposition under low stress deposition conditions.

Further, CVD can also be used to fabricate the X-ray generating (e.g., tungsten) films. In particular, chemical vapor deposition produces films conformal to a rough surface as it is a non-line-of-sight deposition technique. Thus, it may be used in deposition steps such as those shown in FIGS. 4-5 for depositing one or more of the layers over the roughened surfaces. The stress in the deposited film can be tailored by adjusting deposition pressure and rate in a manner similar to sputter deposition.

Figure 6:
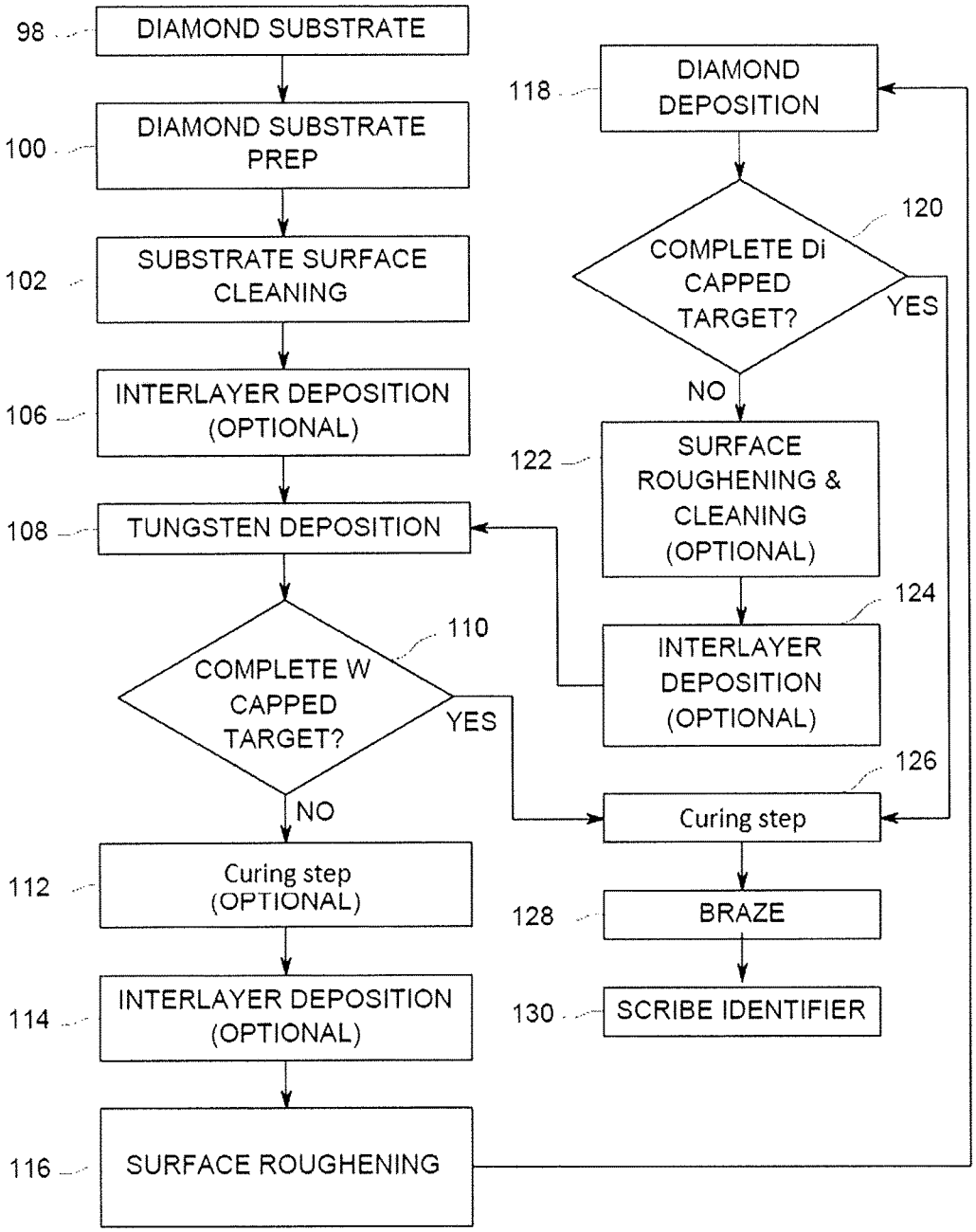
FIG. 6 depicts a process flow depicting example steps in a multi-layer source target fabrication, in accordance with aspects of the present disclosure.

With the preceding discussion in mind, FIG. 6 depicts an example of a process flow suitable for fabricating a tungsten and diamond multi-layer source target 54 that is resistant to delamination of the layers. In particular, the depicted process flow provides for the fabrication of a multi-layer source target having with layers exhibiting mechanical stability and low internal stress states. It should be appreciated that the steps and operations described with respect to FIG. 6 describe only one implementation of a suitable layer deposition process so as to provide a useful example and practical context. Thus, unless indicated otherwise, certain of the described steps may be omitted (i.e., are optional) or may be performed under different conditions or using different techniques (e.g., deposition techniques) while still falling within the scope of the present disclosure. Indeed, while certain steps may be called out as optional, other steps may also be optional or unnecessary in a given implementation or context, such as where quality standards, product reliability, or costs factors are countervailing considerations. Thus, it should be understood that the following example is a non-limiting example, provided merely for illustrative purposes and not as an explicitly limiting guideline.

In the depicted example, a diamond substrate 98 is initially provided and this substrate 98 undergoes a cleaning process 100 to prepare the surface of the substrate 98 for further processing. In the depicted example, the surface of the diamond substrate undergoes roughening operation 102.

In the depicted example, an optional interlayer deposition step 106 may be performed on the diamond surface at either room temperature or elevated temperatures by plasma vapor deposition, RF sputtering, or other suitable film deposition techniques. By way of example, the interlayer can be a carbide layer only, or a combination of a carbide layer followed by a non-carbide ductile layer (by itself or alloyed with tungsten).

A layer of tungsten is then deposited (step 108) on the interlayer covered diamond substrate at either room temperature or elevated temperatures by plasma vapor deposition, RF sputtering, or other suitable film deposition techniques. In one plasma vapor deposition implementation the conditions of the operation are changed over time so as to vary the stress and the density of the deposited tungsten layer, such as creating a density gradient from higher density to lower as deposition proceeds. By way of example, the first stage of the deposition is conducted at a lower pressure, resulting in approximately 0.1 μm of tungsten being deposited, the second stage of the deposition is conducted at an intermediate pressure, resulting in approximately 1.0 μm of tungsten being deposited, and the third stage of the deposition is conducted at a higher pressure, resulting in approximately 10 μm of tungsten being deposited, with the tungsten deposited in the different stages being at different densities. Thus, at the end of step 108, a roughened diamond substrate is present on which a layer of tungsten has been deposited having a graded or gradient density profile.

A determination may be made (block 110) as to whether additional diamond and tungsten and diamond layers are to be added to the multi-layer source target being fabricated. If no additional layers are to be added, the stack is subjected to a curing step 126 to set or cure the layered assembly.

If more layers are to be added, the process returns to optional curing step 112 in preparation for the next film deposition step. In the depicted example, the diamond substrate and tungsten layer may, optionally, be cured under suitable conditions.

In the depicted example, an additional optional interlayer deposition step 114 may be performed on the tungsten surface at either room temperature or elevated temperatures by plasma vapor deposition, RF sputtering, or other suitable film deposition techniques. By way of example, the interlayer can be a non-carbide ductile layer (by itself or alloyed with tungsten) followed by a carbide layer formed the tungsten surface.

In the depicted example, the tungsten deposition 108 (or optional interlayer 114 and curing step 112) is followed by a surface preparation step 116 performed on the surface. In one implementation, the surface preparation step 116 involves a mechanical or chemical roughening process, or a combination of the two.

At step 118 a diamond deposition is performed on the roughened tungsten surface. In one implementation, the CVD diamond deposition involves exposing the roughened tungsten surface to a mixture of gases such as methane (or other carbon-containing gas species), hydrogen, and nitrogen at high temperature until the diamond film reaches a thickness of approximately 8 μm to 15 μm. The desired diamond thickness depends on the incident beam energy and cross section. In this case the beam energy is 300 keV and the cross section is elliptical with an average diameter of 50 μm.

A determination may be made (block 120) as to whether an additional tungsten layer is to be added to the multi-layer source target being fabricated. If no additional tungsten layer is to be added, the stack is instead cured at step 126 to set or cure the layered assembly.

An optional roughening and cleaning step 122 may be performed if additional layers (such as additional tungsten and diamond layers) are to be fabricated on top of the diamond layer so as to improve mechanical adherence and decrease delamination. Conversely, if no additional layers are to be fabricated on the diamond layer, step 122 may be omitted.

In the depicted example, an optional interlayer deposition step 124 may be performed on the diamond surface at either room temperature or elevated temperatures by plasma vapor deposition, RF sputtering, or other suitable film deposition techniques. By way of example, the interlayer can be a carbide layer only, or a combination of a carbide layer followed by a non-carbide ductile layer (by itself or alloyed with tungsten).

Upon completion steps 122 and 124, the multilayer stack goes back to step 108 for additional film deposition and treatment until the desired number of tungsten layers and diamond layers are reached.

If no additional layers are to be added, the stack of layers is instead subjected to a curing step 126 to set or cure the layered assembly.

As part of the X-ray source target fabrication, the multilayer target assembly fabricated in accordance with these steps may be brazed (step 128) to a copper target and the excess brazing material removed. An identifier may be laser scribed (step 130) on the copper target as part of this fabrication process.

Technical effects of the invention include providing a multi-layer X-ray source target having increased heat dissipation in the target that allows increased X-ray production and/or smaller spot sizes. Increased X-ray production allows for faster scan times for inspection. Further, increased X-ray production would allow one to maintain dose for shorter pulses in the case where object motion causes image blur. Smaller spot sizes allow higher resolution or smaller feature detectability. In addition, the technology increases the throughput and resolution of X-ray inspection, and reduces the cost.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An X-ray source, comprising:

an emitter configured to emit an electron beam; and a target configured to generate X-rays when impacted by the electron beam, the target comprising:

at least one X-ray generating layer of a single X-ray generating material, wherein the single X-ray generating material within the at least one X-ray generating layer varies in density within the respective at least one X-ray generating layer to have greater density in earlier deposited regions than in at least a portion of later deposited regions; and at least one thermally-conductive layer in thermal communication with each X-ray generating layer.

2. The X-ray source of claim 1, further comprising a thermally-conductive substrate on which a bottommost X-ray generating layer is formed.

3. The X-ray source of claim 1, wherein the single X-ray generating material comprises tungsten, molybdenum, titanium-zirconium-molybdenum alloy (TZM), tungsten-rhenium alloy, copper-tungsten alloy, chromium, iron, cobalt, copper, or silver.

4. The X-ray source of claim 1, wherein the at least one thermally-conductive layer comprises one or more of highly ordered pyrolytic graphite (HOPG), diamond, beryllium oxide, silicon carbide, copper-molybdenum, copper, tungsten-copper alloy, or silver-diamond.

5. The X-ray source of claim 1, further comprising one or more interface layers disposed between each X-ray generating layer of the at least one X-ray generating layer and the at least one thermally-conductive layer.

6. The X-ray source of claim 5, wherein the one or more interface layers comprise one or both of a carbide interlayer or a non-carbide interlayer.

7. An X-ray source, comprising:

an emitter configured to emit an electron beam; and a target configured to generate X-rays when impacted by the electron beam, the target comprising:

one or more X-ray generating layers, at least one X-ray generating layer of the one or more X-ray generating layers of a single X-ray generating material, wherein the single X-ray generating material within the at least one X-ray generating layer has a density profile that decreases in at least one direction corresponding to a deposition sequence such that later deposited portions of the respective at least one X-ray generating layer are less dense; and at least one thermally-conductive layer in thermal communication with each X-ray generating layer.

8. The X-ray source of claim 7, further comprising a thermally-conductive substrate on which a bottommost X-ray generating layer is formed.

9. The X-ray source of claim 7, wherein the single X-ray generating material comprises tungsten, molybdenum, titanium-zirconium-molybdenum alloy (TZM), tungsten-rhenium alloy, copper-tungsten alloy, chromium, iron, cobalt, copper, or silver.

10. The X-ray source of claim 7, wherein the at least one thermally-conductive layer comprises one or more of highly ordered pyrolytic graphite (HOPG), diamond, beryllium oxide, silicon carbide, copper-molybdenum, copper, tungsten-copper alloy or silver-diamond.

11. The X-ray source of claim 7, further comprising one or more interface layers disposed between each X-ray generating layer and the at least one thermally-conductive layer.

12. The X-ray source of claim 11, wherein the one or more interface layers comprise one or both of a carbide interlayer or a non-carbide interlayer.

13. A method for fabricating an X-ray source, comprising:

depositing a single X-ray generating material on an underlying surface to form an X-ray generating layer, wherein the single X-ray generating material is deposited at one or both of different pressures or temperatures to have different densities at different depths within the X-ray generating layer;

depositing a thermally conductive layer on the X-ray generating layer to form a thermally conductive layer; and positioning an emitter so that, when in use, an electron beam from the emitter impacts the X-ray generating layer and generates X-rays.

14. The method of claim 13, wherein depositing the single X-ray generating material comprises depositing the single X-ray generating material at successively higher pressures as the deposition progresses.

15. The method of claim 13, wherein the single X-ray generating material comprises tungsten, molybdenum, titanium-zirconium-molybdenum alloy (TZM), tungsten-rhenium alloy, copper-tungsten alloy, chromium, iron, cobalt, copper, or silver.

16. The method of claim 13, wherein depositing the single X-ray generating material and depositing the thermally conductive layer are repeated at least twice to form a multi-layer X-ray source target.

17. The method of claim 13, wherein depositing the single X-ray generating material comprises:

depositing the single X-ray generating material using chemical vapor deposition or plasma vapor deposition at successively higher pressures over time so that tungsten is deposited at different densities at different times.

18. The method of claim 13, wherein depositing the thermally conductive layer comprises:

exposing the X-ray generating layer to a carbon-containing gas species at elevated temperatures.

* * * * *